United States Patent [19]

Nadin

[11] Patent Number: 5,000,699

[45] Date of Patent: Mar. 19, 1991

[54] DEVICE FOR INTERCONNECTING CONDUCTORS IN A GROUP OF ELECTRICAL CONDUCTORS

[75] Inventor: Léonard Nadin, L'Union, France

[73] Assignee: Societe anonyme dite: Labinal, Montigny Le Bretonneux, France

[21] Appl. No.: 543,367

[22] Filed: Jun. 26, 1990

[30] Foreign Application Priority Data

Aug. 7, 1989 [FR] France ..... 89 10602

[51] Int. Cl.[5] ..... H01R 31/08

[52] U.S. Cl. ..... 439/511; 439/49; 439/189; 439/507; 439/516

[58] Field of Search ..... 439/49, 189, 507, 509–511, 439/516, 885

[56] References Cited

U.S. PATENT DOCUMENTS

| | | | |
|---|---|---|---|
| 2,901,526 | 8/1959 | Huntley et al. | 439/507 |
| 3,611,251 | 10/1971 | Downhill | 439/49 |
| 4,019,094 | 4/1977 | Dinger et al. | 439/511 |
| 4,089,041 | 5/1978 | Lockard | 439/511 |
| 4,090,667 | 5/1978 | Crimmins | 439/189 |
| 4,401,353 | 8/1983 | McDevitt, Jr. et al. | 439/189 |
| 4,552,423 | 11/1985 | Swengel et al. | 439/507 |
| 4,591,221 | 5/1986 | De Brouckere et al. | 439/509 |
| 4,643,507 | 2/1987 | Coldren | 439/507 |
| 4,897,047 | 1/1990 | Connell et al. | 439/189 |

OTHER PUBLICATIONS

Rogers Corporation "Clip-on Buss" 5/7/75—See FIG. 3.

*Primary Examiner*—Paula A. Bradley

*Attorney, Agent, or Firm*—Sandler, Greenblum & Bernstein

[57] ABSTRACT

A device for interconnecting conductors in a group of electrical conductors includes a casing having at one end an opening adapted to receive a complementary member. It is adapted at the other end to receive a connecting strip. In its back it has a partition with two series of channels passing through it. The connecting strip is bent from a flat blank of a good electrical conductor to form a U-shape comprising flanges and a core. Parallel tangs perpendicular to the core of the U-shape are cut out from the flanges. The device further comprises a cover with latching devices adapted to cooperate with corresponding latching devices on the casing to lock the connecting strip against the partition by pressing against the outside of the core of the connecting strip.

3 Claims, 4 Drawing Sheets

DEVICE FOR INTERCONNECTING CONDUCTORS IN A GROUP OF ELECTRICAL CONDUCTORS

BACKGROUND OF THE INVENTION

1. Field of the invention

The present invention concerns a device for interconnecting conductors in a group of electrical conductors.

The invention is directed to the implementation of groups of electrical conductors supplying different electrical devices or equipments.

2. Description of the prior art

Primary conductors are designed to be connected to the electrical power supply and secondary conductors are usually spliced to the primary conductors.

The invention is directed to an interconnection device designed to eliminate splicing.

SUMMARY OF THE INVENTION

The invention consists in a device for interconnecting conductors in a group of electrical conductors comprising a casing having at one end an opening adapted to receive a complementary member, adapted at the other end to receive a connecting strip and having in its back a partition comprising two series of channels passing through it, said connecting strip being bent from a flat blank of a good electrical conductor to form a U-shape comprising flanges and a core, parallel tangs perpendicular to said core of said U-shape being cut out from said flanges, the device further comprising a cover with latching means adapted to cooperate with corresponding latching means on said casing to lock said connecting strip against said partition by pressing against the outside of said core of said connecting strip.

The resulting device is simple and highly practical. The connecting strip preferably comprises a greater number of tangs on an upper flange than on the other flange.

Finally, the core of the connecting strip comprises, straddling the bending lines for the flanges, openings to facilitate cutting the connecting strip.

The invention will now be described in more detail with reference to one embodiment given by way of example only and shown in the appended diagrammatic drawings.

DETAILED DESCRIPTION OF THE INVENTION

Figure 1:
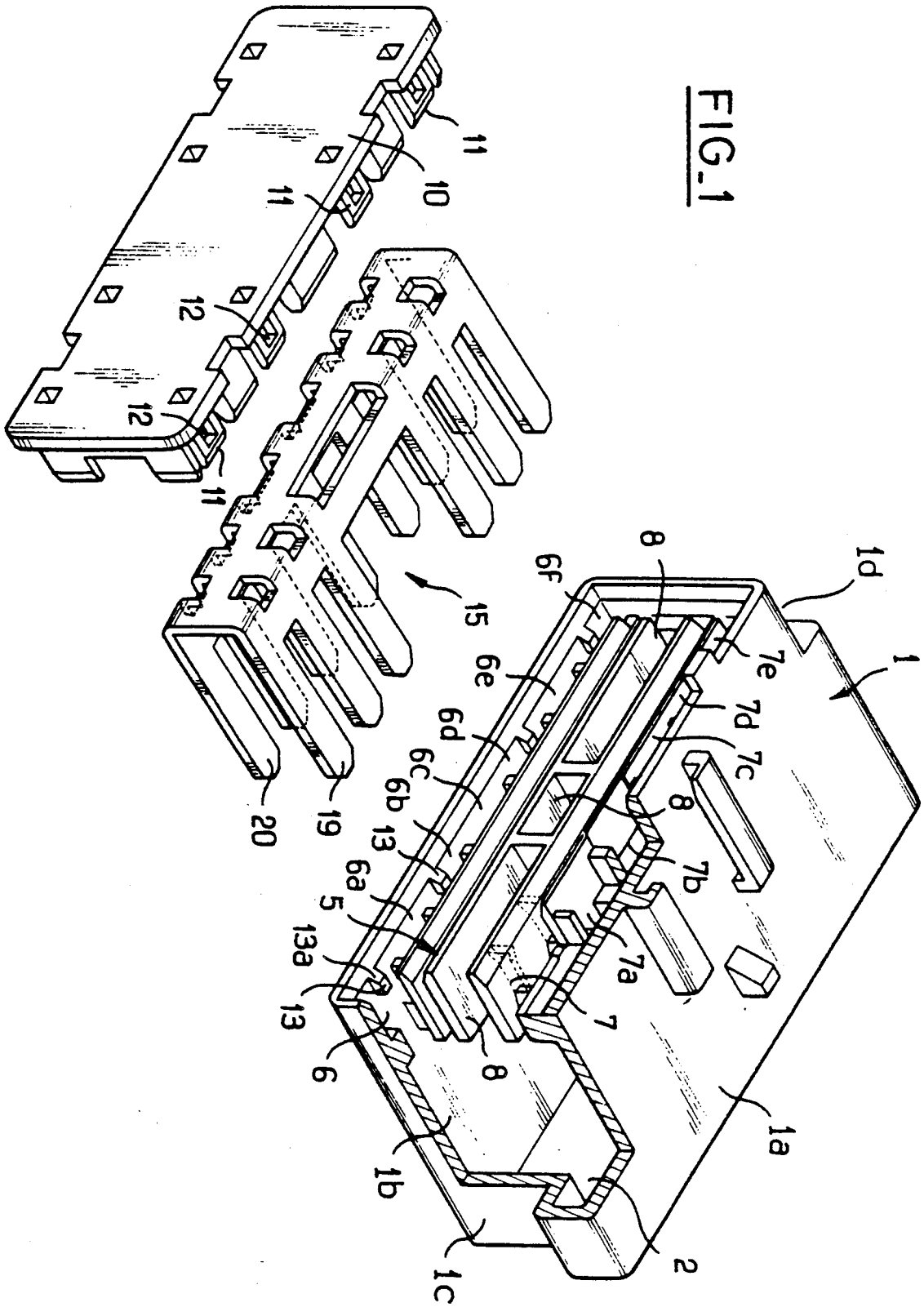
FIG. 1 is an exploded perspective view of the device in accordance with the invention.
Figure 2:
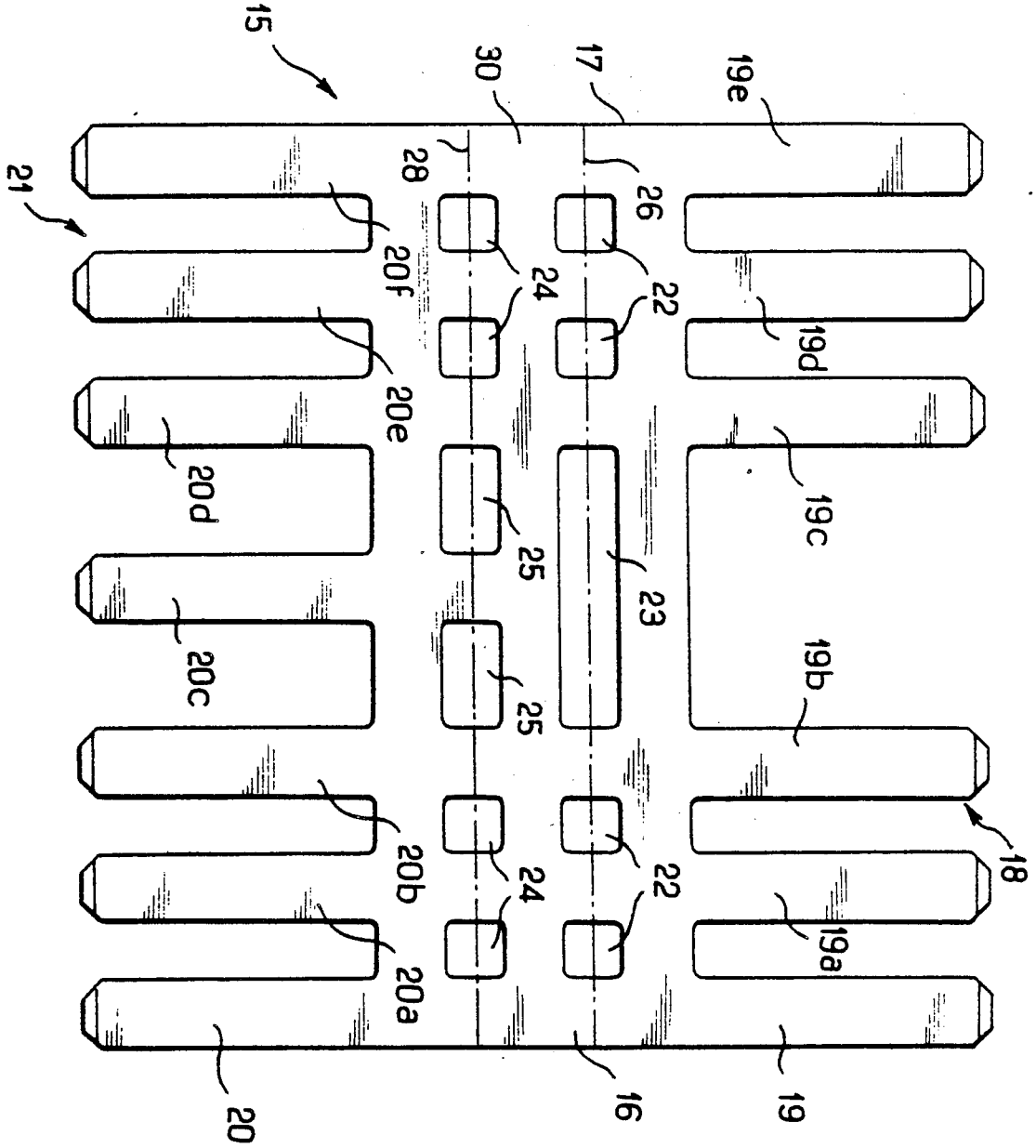
FIG. 2 is a plan view of the connecting strip before bending.

The device shown in the figures comprises a casing 1 formed of a generally parallelepiped-shape body with four sides 1*a* through 1*d*, one side of which includes an opening designed to receive a connector (not shown), and provided with a series of female members connected to appropriate circuits.

The back of the casing 1 is closed by an apertured partition 5 comprising in the part adjacent the side 1*b* seven channels 6 through 6*f* and in the part adjacent the side 1*a* six channels 7 through 7*e*, three large openings 8 being formed in the intermediate part.

The casing 1 is completed by a lid 10 comprising lugs 11 formed with a central opening 12 and designed to cooperate with studs 13 on the body 1 each having a ramp surface 13*a* so that when the lid is fitted the lugs 11 cooperate with said studs, deforming elastically where they bear against the ramp surfaces 13*a* and subsequently capping the studs which locate in the openings 12 to latch said lid to the body.

The body 1 is adapted to receive a connecting strip 15 which is cut out from a sheetmetal blank which is a good conductor of electricity and is generally rectangular in shape with two shorter sides 16 and 17 and two longer sides 18 and 21.

Six tangs 19 through 19*e* are cut out from the longer side 18 and seven tangs 20 through 20*f* are cut out from the longer side 20.

Between the tangs 19 and 20 is a central strip 30 from which are cut out aligned openings 22 and 23 perpendicular to the sides 16 and 17.

The connecting strip is folded into a U-shape along two lines 26 and 28, the first passing through the median plane of the openings 22 and the second through the median plane of the openings 24 and 25. Thus the tangs are cut out from the flanges of the U while the core is constituted by the strip 30.

The connecting strip is adapted to be inserted into the casing 1, the tangs 20 through 20*f* being inserted into the channels 6 through 6*f* and the tangs 19 through 19*e* into the channels 7 through 7*e*.

Figure 3:
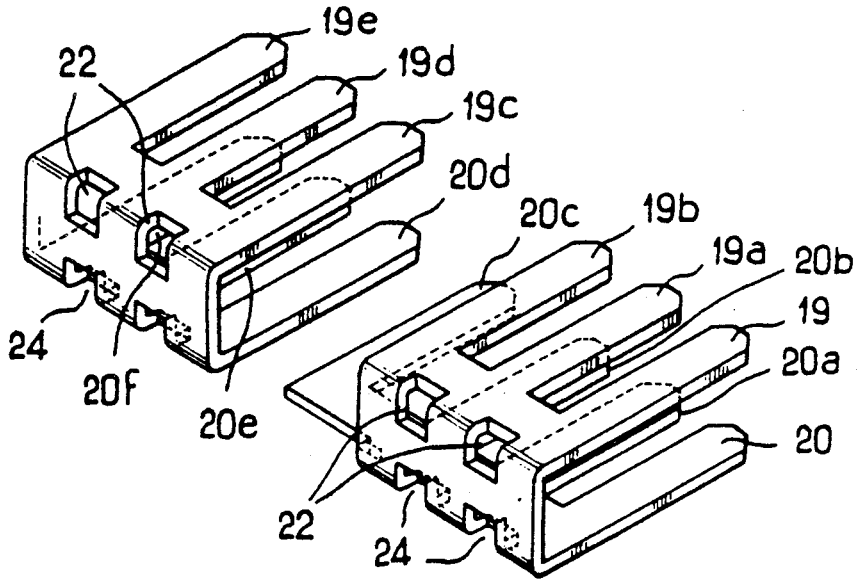
FIGS. 3 through 6 show in perspective various possible ways of cutting the connecting strip.
Figure 4:
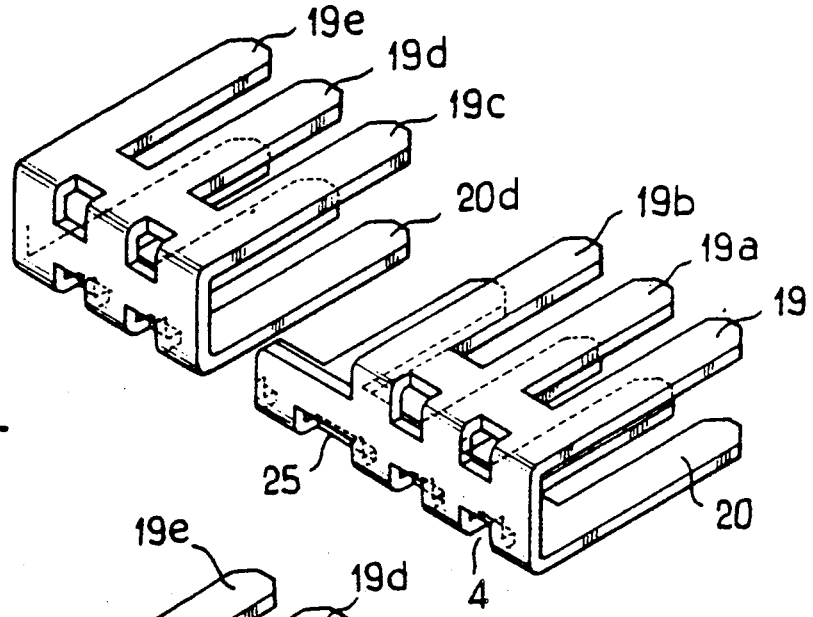
Figure 5:
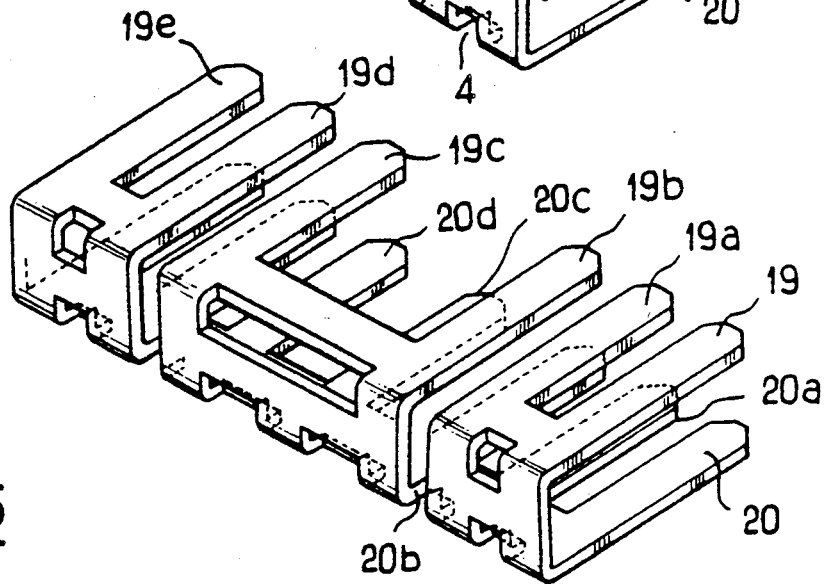

As seen in FIGS. 3, 4 and 5 the connecting strip 15 may be cut in various ways according to the electrical connections to be made.

In FIG. 3 the strip 15 is cut along a line passing along the edge of the tang 19*b*, through the opening 23, the opening 25 and along the tang 20*d*, the part of the strip between the openings 25 and the part between the tangs 19*c* and 19*d* being eliminated.

FIG. 4 shows a configuration similar to the FIG. 3 configuration but in which only the part between the opening 23 and the side between the tangs 19*c* and 19*d* are eliminated.

In the FIG. 5 variant the strip is cut into three sections, the first comprising the tangs 19, 19*a*, 20 and 20*a*, the second the tangs 19*b*, 19*c* and 20*b*, 20*c* and 20*d* and the third the tangs 19*e*, 19*d* and 20*f*, 20*e*.

Figure 6:
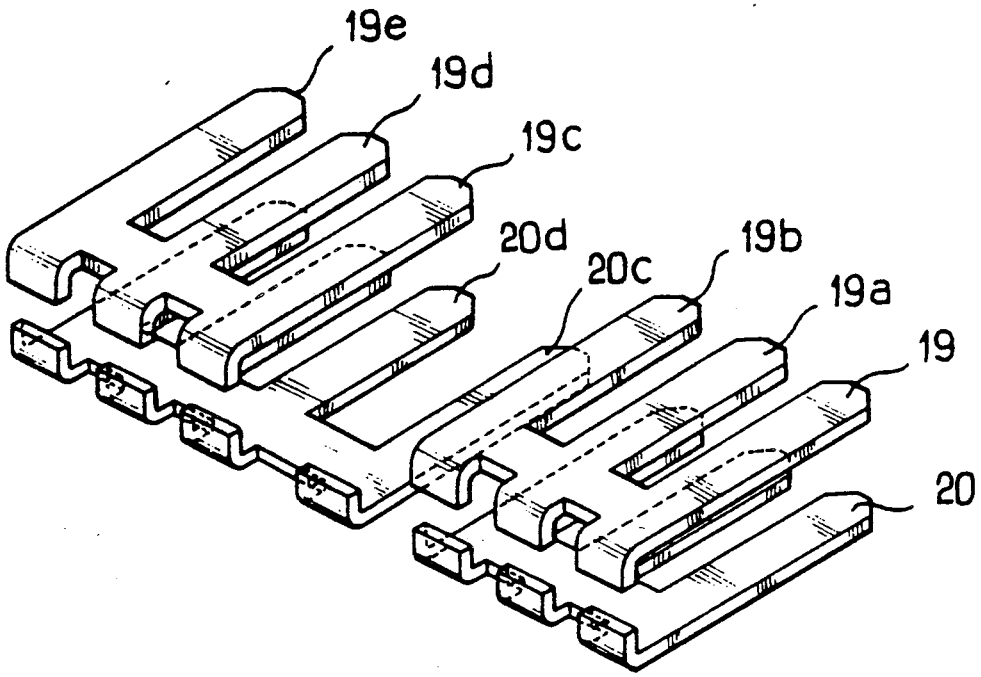

Finally, in the FIG. 6 variant the strip is cut along the lines 26 and 28 and also along the tangs 19*b* and 20*b*.

The casing 1 is usually designed to receive a casing member inserted through the opening 2 and fitted with female contact members which fit over the tangs 19 and 20 to make connections to a conductor connected to a power supply without splices being necessary.

Of course, the invention is not limited to the embodiment that has been described and shown. Numerous modifications of detail may be made thereto without departing from the scope of the invention.

There is claimed:

1. Device for interconnecting conductors in a group of electrical conductors comprising a casing having at one end an opening adapted to receive a complementary member, adapted at the other end to receive a connecting strip and having in its back a partition comprising two series of channels passing through it, said connecting strip being bent from a flat blank of a good electrical conductor to form a U-shape comprising flanges and a core, parallel tangs perpendicular to said core of said U-shape being cut out from said flanges, the device further comprising a cover with latching means adapted to cooperate with corresponding latching means on said casing to lock said connecting strip against said partition by pressing against the outside of said core of said connecting strip.

2. Device according to claim 1 wherein said connecting strip comprises a greater number of tangs on an upper flange than on the other flange.

3. Device according to claim 1 wherein said core of said connecting strip comprises openings straddling the bending lines of said flanges.

* * * * *